US008854168B2

(12) United States Patent
Bedini

(10) Patent No.: US 8,854,168 B2
(45) Date of Patent: Oct. 7, 2014

(54) HIGH VOLTAGE ELECTRO INDUCTIVE SWIVEL

(75) Inventor: Mauro Bedini, Vintimille (IT)

(73) Assignee: Single Buoy Moorings Inc., Marly (CH)

( * ) Notice: Subject to any disclaimer, the term of this patent is extended or adjusted under 35 U.S.C. 154(b) by 99 days.

(21) Appl. No.: 13/381,998

(22) PCT Filed: Jul. 2, 2010

(86) PCT No.: PCT/EP2010/059443
§ 371 (c)(1),
(2), (4) Date: Feb. 16, 2012

(87) PCT Pub. No.: WO2011/000937
PCT Pub. Date: Jan. 6, 2011

(65) Prior Publication Data

US 2012/0133468 A1 May 31, 2012

(51) Int. Cl.

| | |
|---|---|
| ***H01F 21/06*** | (2006.01) |
| ***H01F 21/04*** | (2006.01) |
| ***H01F 38/18*** | (2006.01) |
| ***B63B 21/50*** | (2006.01) |

(52) U.S. Cl.
CPC ..... *H01F 38/18* (2013.01); *B63B 21/507* (2013.01)
USPC ..... 336/120; 336/115; 336/117; 336/118; 336/121; 336/130

(58) Field of Classification Search
USPC ..... 336/115, 117, 118, 120, 121, 130
See application file for complete search history.

(56) References Cited

U.S. PATENT DOCUMENTS

| | | | | |
|---|---|---|---|---|
| 2,872,603 | A * | 2/1959 | Herr | 310/111 |
| 2,958,057 | A * | 10/1960 | Berman | 336/135 |
| 3,195,039 | A * | 7/1965 | Koning | 323/348 |
| 3,317,874 | A | 5/1967 | Honsinger | |
| 3,430,173 | A * | 2/1969 | Orlando | 336/79 |
| 5,572,178 | A * | 11/1996 | Becker et al. | 336/120 |
| 6,388,548 | B1 * | 5/2002 | Saito et al. | 336/90 |
| 6,512,437 | B2 * | 1/2003 | Jin et al. | 336/178 |
| 6,559,560 | B1 * | 5/2003 | Jin et al. | 307/104 |

FOREIGN PATENT DOCUMENTS

| | | | |
|---|---|---|---|
| GB | 2 115 230 | A | 9/1983 |
| SU | 1 580 493 | A1 | 7/1990 |
| WO | 2009/027938 | A2 | 3/2009 |
| WO | 2009/128724 | A1 | 10/2009 |

OTHER PUBLICATIONS

International Search Report, dated Sep. 8, 2010, from corresponding PCT application.

* cited by examiner

*Primary Examiner* — Tsz Chan
(74) *Attorney, Agent, or Firm* — Young & Thompson

(57) ABSTRACT

Power swivel for transmitting electrical power from a first terminal to a second terminal, includes a central part with a hub and an outer ring of a magnetic material, coaxial with and surrounding the hub, the outer ring and central part being rotatable relative to one another around a vertical axis, at least two radial arms of a magnetic material projecting from the hub or from the outer ring, adjacent arms being spaced-apart, each arm carrying a conductor wound around the arm to form a coil for generating a magnetic flux along a radial flux path through the arm, the conductors being connected to the first terminal, wherein the outer ring or the hub has a cylindrical surface at close proximity to free ends of the arms, a plurality of axially extending conductors being distributed along the circumference of the outer ring or hub at or near the cylindrical surface.

12 Claims, 6 Drawing Sheets

HIGH VOLTAGE ELECTRO INDUCTIVE SWIVEL

FIELD OF THE INVENTION

The present invention relates to a high voltage electro inductive power swivel. The invention in particular relates to a power swivel for use in a weathervaning offshore structure, such as a floating single point moored unit.

BACKGROUND OF THE INVENTION

It is known to generate electrical power on-board floating barges located offshore and to transfer the power to shore and into the electricity network. Normally, such barges are spread-moored in a manner which does not allow the barge to weathervane around the mooring in response to the action of wind, waves and currents. Alternatively, such barges may be turret-moored wherein mooring lines are attached to a turret rotatably mounted in the hull of the barge. This system allows the vessel to weathervane around the turret and the mooring lines in response to wind, wave and current action.

If a barge is turret-moored in this way, an electrical swivel apparatus is required on top of the turret in order to transfer the power from the weathervaning barge to stationary subsea cabling. Usually, a large amount of power is being produced in these situations, in the order of 100 to 500 MW, and thus a large electrical swivel is required.

Furthermore, offshore transmission of large amounts of AC electric power over long distances requires very high voltages in order to avoid the need for large cross-section copper cables and by consequence very heavy and expensive cables.

A solution to reduce the cross section of the conductor in submarine cables is to transform the electric AC power into DC power, but this requires big, expensive, and relatively inefficient converter stations.

A high-voltage, direct current (HVDC) electric power transmission system uses direct current for the bulk transmission of electrical power, in contrast with the more common alternating current systems. For long-distance distribution, HVDC systems require cables with smaller cross-section and therefore are less expensive and suffer lower electrical losses.

For shorter distances, the higher cost of DC conversion equipment compared to an AC system may be warranted where other benefits of direct current links are useful.

The actual high voltage electric swivel for single point moored floating production units is a bottleneck for the increase of the voltage of the submarine cables. Very high voltage swivels made according to actual technologies would require a very big spacing between the slip rings, and very high quality insulating fluid. Furthermore, a very high voltage electric swivel would require big and expensive transformers on the floating production unit.

In WO 2009/128724 a rotary transformer is described for use in the turret of offshore floating production storage and offloading (FPSO) systems or on wind turbines. In FIG. 10 of WO 2009/128724 a three-phase rotary transformer with a vertical air gap is described in which the inner and outer swivel rings are provided with radial legs each carrying a primary or secondary conductor winding, which windings are facing one another. The known swivel requires a relatively large size for high power applications. Furthermore, the distribution of the windings on the outer rotor part results in a relatively inefficient coupling of the magnetic field that is generated in the windings of the inner stator core element.

The magnetic field traverses a relatively large air gap to induce an induction current in the coils on the outer ring-shaped rotor.

It is therefore an object of the present invention to provide a power swivel which allows efficient power transfer. It is a further object to provide a power swivel that can transfer high voltages while being of a compact design and of a relatively low weight.

Furthermore, the power swivel according to the present invention should allow for adapting the power to needs (either power consumption or production) of a floating unit in dependence on the power levels and transmission distances while minimizing power losses. The power swivel should be able to avoid the use of dielectric fluid as a main insulator, thus reducing the risk of a short circuits in the swivel and also avoiding any wear caused by sliding contacts. The present invention aims to propose a much more compact and more efficient alternative to HVDC technology for transmission of high power over medium to long distances.

SUMMARY OF THE INVENTION

Hereto a power swivel according to the present invention for the transmission of electrical power from a first terminal to a second terminal comprises a central part with a hub and an outer ring of a magnetic material, coaxial with the hub and surrounding the hub. The outer ring and the central part are rotatable relative to one another around a vertical axis, at least two radial arms of a magnetic material projecting from the hub or from the outer ring. Adjacent arms are spaced-apart, each arm carrying a conductor wound around the arm to form a coil adapted for generating a magnetic flux along a radial flux path through the arm, the conductors being connected to the first terminal, wherein the outer ring or the hub has a cylindrical surface at close proximity to the free ends of the arms, a plurality of axially extending conductors being distributed along the circumference of the outer ring or hub at or near the cylindrical surface such that a number of axial conductors is each time situated between two adjacent radial arms. Pairs of axial conductors form coils situated along the cylindrical surface adapted for generating a magnetic flux along a magnetic flux path extending in a circumferential direction through the outer ring or hub, a closed contour being formed extending radially outwardly from a first radial arm, into the outer ring, via the outer ring to the adjacent radial arm and radially inwardly along said adjacent arm and via the hub back to the first arm.

The distribution of the vertical conductors in the outer ring or in the hub, near the cylindrical surface of said outer ring or hub, provides for an efficient coupling with the magnetic flux of the conductor windings around the radial arms. This allows transfer of high power levels at a reduced swivel size. In this way the power swivel of the present invention can be mounted in a swivel stack among other components, such as hydrocarbon fluid swivels or electrical swivels. The compact and light weight swivel of the present invention is especially suitable to be used in conditions where limited space is available, such as offshore applications.

In particular, the reduced size results in reduced manufacturing tolerances and a decreased size of the air gap between the radial arms and the coils on the outer ring of the power swivel according to the present invention.

By the compact size of the power swivel according to the present invention, the volume in which strong magnetic fields are present can remain low, resulting in improved safety of the power swivel, which is especially relevant for offshore applications.

In the swivel of the present invention, both the hub and outer ring can either function as a rotor or as a stator. The power swivel of the present invention can transfer power between a non-rotating terminal and a rotating terminal with or without transforming said power, depending on the ratio of the number of windings on the radial arms and the number of windings on the opposite hub or outer ring.

The radial arms may be placed on the central hub extending outwardly, the axial conductors being situated at or near the inner surface in the outer ring. Alternatively, it is possible to place the radial arms on the inner surface of the outer ring, extending radially inwards towards the hub, the axial conductors being situated at or near the cylindrical outer surface of the hub.

One embodiment of a power swivel of the present invention provides a solution where a high voltage rotary transformer is applied to a single point moored Floating Production Unit (FPU). According to the present invention there is provided a floating unit mooring apparatus comprising a turret structure rotatably mountable to a floating unit, at least one mooring line securable to the turret and an electrical cable connectable to the floating unit, wherein the cable is connected to a high voltage rotary transformer combined to the turret. The high voltage rotary transformer is placed on the turret, it has a fixed part (stator) connected to the fixed part of the single point moored unit and a rotating part (rotor), rigidly connected to the floating unit. In the electric transformer a magnetic field is induced by the very high voltage current flowing in the stator windings, which magnetic field induces a current in the rotor windings at a tension which is adapted to the ship circuit needs.

In this way, the invention avoids the need for a slip ring-based swivel by allowing efficient transmission of electric power between the fixed and the rotating part of a single point moored FPU. According to the present invention there is no sliding contact between the rotor windings and the stator windings of the high voltage rotary transformer so that it is possible to use a solid insulation protecting the windings. This insulation enables to reduce the risk of a short circuit in the swivel and also allows a higher density of the electric field.

These characteristics provide the advantages of avoiding the use of a dielectric fluid as a main insulator. As there is no need for sliding contacts, there are no parts subject to wear over a long life span.

The present solution also has the advantage that it enables the use of smaller cross-section cables and hence results in cost savings. As the swivel can be operated at higher voltages (e.g. ideally more than what electrical swivels in existing floating offshore systems can handle), the overall electrical power transmission losses are reduced and hence the cross-section of the electrical cable can be reduced. The present solution is a much more compact and more efficient alternative to High Voltage Direct Current (HVDC) technology for transmission of high power over medium-long distances.

An embodiment of a power swivel according to the invention comprises at least six radial arms, pairs of arms extending diametrically from the hub or the outer ring, a first arm forming a magnetic pole of a predetermined sign, the diametrically opposed arm and the adjacent arms on each side of the first arm forming magnetic poles of the opposite sign.

This configuration of poles in which the windings in the outer ring have the same angular pattern as the radial arms, allows a simple swivel design in which the current in the windings flows in a predetermined direction while the magnetic flux in the outer ring changes direction between each pair of adjacent poles.

Additional redundancy is obtained in an embodiment of a power swivel according to the invention wherein the conductors of at least two radial arms are connected in parallel to the first terminal.

In a further embodiment at least two arms comprise a mutually different number of conductor windings, the two arms each being connected to a respective terminal. The swivel can be used as a transformer and different conductor windings on the arms can correspond to respective voltages. Power that is generated on board the offshore structure can be supplied to installations operating at a specific voltage by supplying the power from a conductor around the radial arm having the number of windings matching the desired operating voltage.

The radial arms of the power swivel according to invention may define an open area between adjacent radial arms for forming an axial passage for a cooling medium. In this manner cooling fluid, for instance air, can travel along the windings in an axial direction either by convection or by forced circulation. Providing adequate cooling allows the transfer of high power levels without the risk of the swivel overheating.

BRIEF DESCRIPTION OF THE DRAWINGS

The invention will be further described below in connection with exemplary embodiments with reference to the accompanying drawings, wherein.

DESCRIPTION OF THE PREFERRED EMBODIMENTS

In the following description the floating unit 1 is formed by a FPSO, but the power swivel according to the invention is not limited to use on an FPSO but could be applied on any type of vessel, floating power unit and even floating wind turbines, floating wave energy converters etc.

Figure 1:
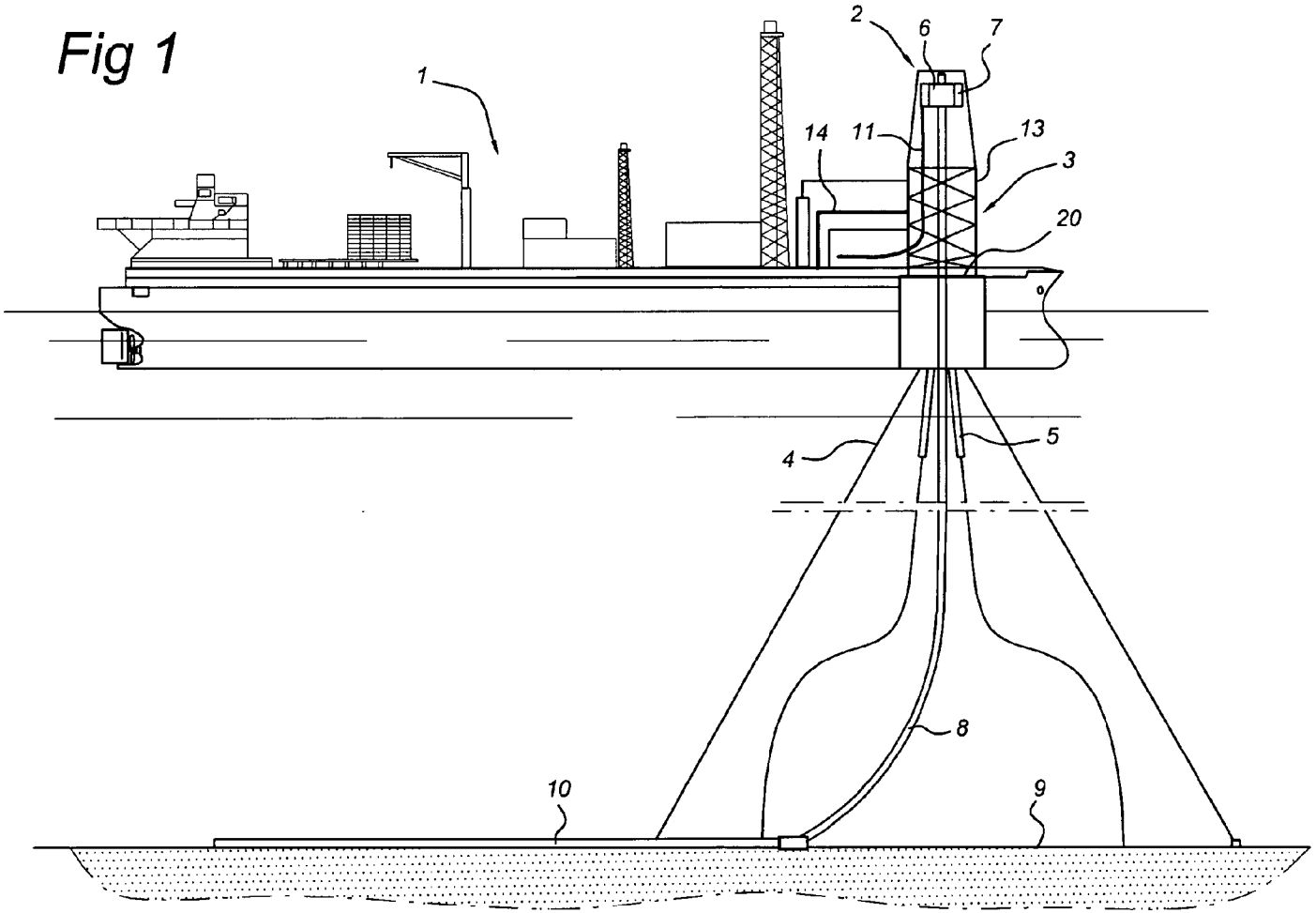
FIG. 1 shows a single point floating unit with a high voltage transformer electro-inductive swivel installed on the turret of the floating unit.

FIG. 1 shows a single point floating unit 1 rotatably coupled to a turret 3 which is anchored to the sea bed 9 via mooring lines 4 so that the floating unit 1 can weathervane about the turret 3. The floating unit 1 has a vertically extending aperture 20 through its hull in which the turret 3 is mounted in a rotatable manner, supported by upper and lower bearings (not shown).

A plurality of mooring lines 4, such as anchor chains, only a part of which is shown for convenience, are attached to the turret 3 in a known manner, for example via a chain stopper to a chain hawse pipe. In this way, the floating unit 1 is able to rotate around the turret 3 and the anchor chains in response to wave, wind and current action.

Risers 5 extend from subsea wells (not shown) on the sea bed and are connected to upper inlet product conduits or lines (not shown) which enter the turret. The risers 5 are coupled to a stack of fluid swivels 13 which comprise toroidal chambers bounded by an inner ring attached to the turret and an outer ring attached to the vessel 1. The outer rings of the stack of fluid swivels 13 are rotatably supported on the inner rings such that the swivels couple the geostationary risers 5 to the product piping 14 which weathervanes with the vessel 1 around the turret 3.

A high voltage transformer electro-inductive power swivel, which in this case is indicated as transformer 2, is combined with the turret 3 of the floating unit 1 and is mounted on the swivel stack 13. The system combines in one construction the power swivel and the first level of a transformer into rotary transformer 2 with a reduction in terms of room needed onboard.

The mooring turret 3 includes a relatively small diameter upper end portion which extends upwardly from the main deck of the floating unit 1. The outer core or rotor 7 (see FIG. 2) of the high voltage rotary transformer 2 is rotatably mounted by means of a bearing at the upper end of the turret 3 so that the outer core or rotor 7 of the high voltage rotary transformer 2 rotates with the floating unit 1 as it weathervanes about the substantially fixed turret 3. The inner core or stator 6 of the high voltage rotary transformer 2 is connected to the fixedly moored part of the floating unit 1.

Riser pipes 5 pass up through the turret 3 and are connected to the fixed part of the turret 3 such that they do not rotate with the floating unit 1 relative to the turret 3 and anchor chains. The risers are connected to inner rings of toroidal fluid swivels in the swivel stack 13, which inner rings are fixed to the turret 3. The risers 5 extend upward through a central space in the swivel stack 13 that is bounded by the inner toroidal swivel rings. The outer rings of the toroidal fluid swivels in stack 13 are coupled to the product piping 14 on the floating unit 1.

A subsea electrical cable 8 passes upwards through the turret 3 inside the vertically extending aperture 20 and trough the central space of the swivel stack 13, and is suspended from a hang-off, such as a clamping device at the bottom of the high voltage rotary transformer 2. The very high voltage dynamic submarine cable 8 is connected to the fixed part or stator 6 of the high voltage rotary transformer 2 and extends to the seabed 9 where it is connected to a very high voltage rigid submarine cable 10.

Another electrical cable 11 connects the floating unit topside to the stator 6 of the high voltage rotary transformer 2.

The power can be transmitted to the high voltage rotary transformer 2 via the cable 11 and then stepped up to high voltage and sent to users via cables 8 and 10. Alternatively, the current at high voltage can be directed towards the floating unit 1 via cables 10 and 8, can be converted into a current at a lower voltage by the high voltage rotary transformer 2 where after cable 11 transfers the power to the floating unit 1 topside.

Figure 2:
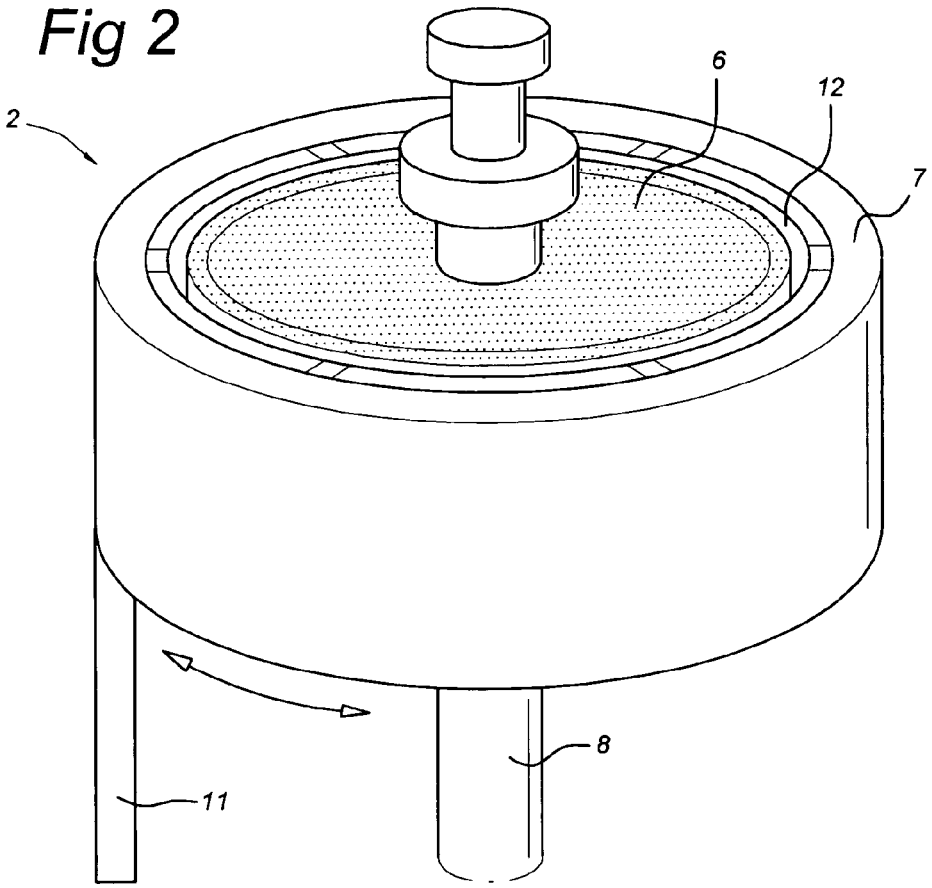
FIG. 2 shows a schematic perspective view of the high voltage transformer electro-inductive swivel according to the present invention.
Figure 3:
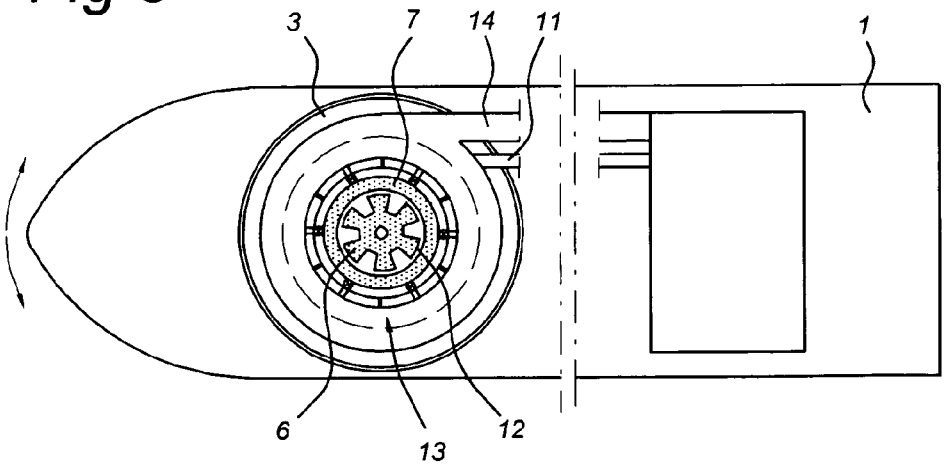
FIG. 3 shows a top view of a floating unit with a high voltage transformer electro-inductive swivel combined with the turret of the floating unit.

FIG. 2 shows a schematic perspective view of the high voltage rotary transformer 2 according to the present invention. FIG. 3 shows a top view of a floating unit with a high voltage transformer electro-inductive swivel combined with the turret 3 of the floating unit. The inner stator 6 is situated within an annular rotor 7, which is separated from the stator by an air gap 12. A number of conductive primary windings is supported on the stator 6 and is connected to the submarine a cable 8, and a number of conductive secondary windings is supported on the rotor 7 such that the AC voltage on the primary windings induces, via the air gap 12, an AC voltage and current in the electrical cable 11. The magnetic field induces a current in the rotor windings at a tension which is adapted to the floating unit circuit needs. Depending on the application the opposite is although true: a magnetic field can be induced by the very high voltage current flowing in the rotor windings, which magnetic field induces a current in the stator windings at a tension which is adapted to the floating unit circuit needs.

In fact, the rotor 7 rotates as the floating unit 1 weathervanes around the turret 3 and the stator 6 is fixed to the moored part of the turret 3 on top of the inner core of swivel stack 13.

Hence the movement of the rotor windings with regards to stator windings does not affect the power transmission between the two parts and the generation of torque is avoided.

In FIGS. 2 and 3 it is clearly shown that there is no sliding contact between the windings on rotor 7 and the windings on stator 6. There is an air gap 12 between both. This transformer design allows to coat the windings wires with an insulation material which reduces the short-circuit current that may occur.

Figure 4:
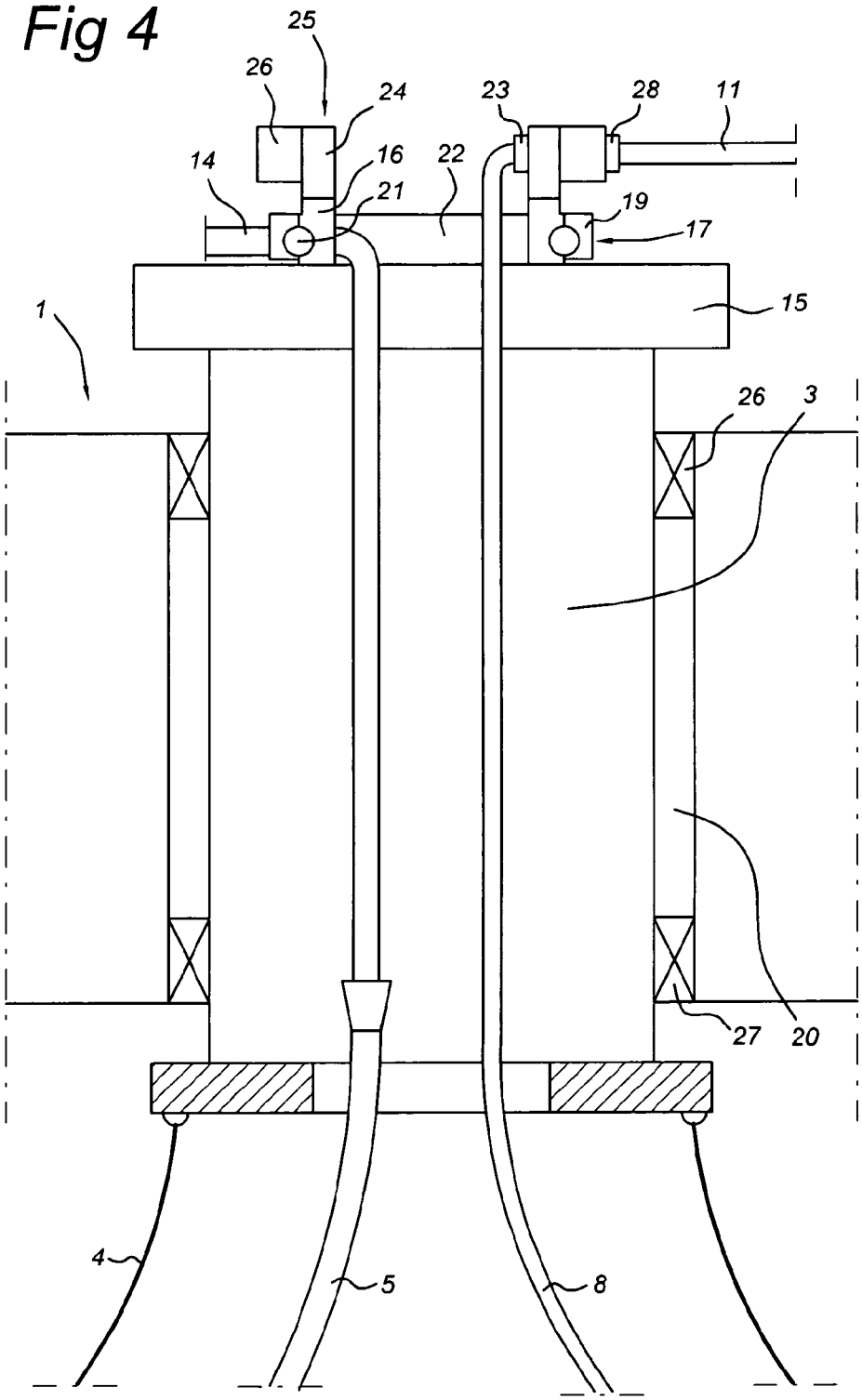
FIG. 4 shows a schematic cross-sectional view of the floating unit of FIG. 3.

FIG. 4 shows a schematic view of the turret 3, carrying on a support deck 15 the inner ring 16 of toroidal hydrocarbon fluid swivel 17. The turret 3 is rotatably supported in the cylindrical aperture or moonpool 20 via upper bearings 26 and lower bearings 27. An outer ring 19 of the swivel is rotatably mounted on the inner ring 16 and defines with the inner ring a toroidal chamber 21. The product piping 14 connects via the toroidal chamber 21, to the product riser 5 that connects to the inner ring 16. The power cable 8 extends through the central space 22 of the swivel 7 (or swivel stack 13 in case multiple swivels are stacked on top of one another) and is connected via a first terminal 23 to the stator 24 of the power swivel 25. An outer ring 26, or rotor, of the power swivel 25 is connected via a second terminal 28 to the electrical cable 11.

Figure 5:
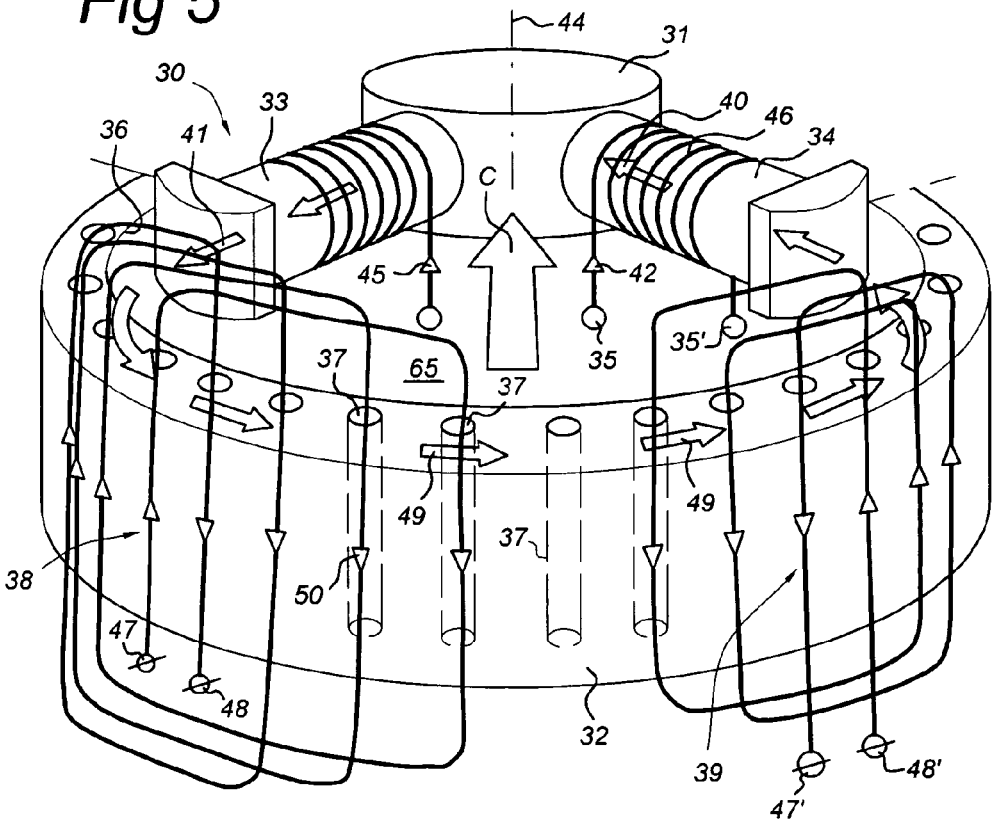
FIG. 5 shows a perspective view of an inductive power swivel of the present invention.

FIG. 5 shows an embodiment of a power swivel 30 according to the invention with a central hub 31 and an outer ring 32, mounted rotatably around central axis 44. The hub 31 carries a number of radial arms 33, 34 around which primary windings 45, 46 are wound to form coils connected to a first terminal 35, 35'. A current passing through the windings 45, 46 in the direction indicated by the arrow 42, causes a flux through the magnetic material of the radial arms 32, 33 in the direction of the arrows 40, 41. At or near a cylindrical inner surface 36 of the outer ring 32, a number of parallel vertical conductors 37 is situated, the conductors being at their upper and lower ends interconnected to form windings. The windings are distributed at an angular spacing along the outer ring 32 corresponding with the pitch of the radial arms 33, 34. The coils are connected to a second terminal 47,48, 47',48'. In a preferred embodiment, the magnetic material of the radial arms 32, 33 is a ferro-magnetic material.

The magnetic field induced by the radial arms 33, 34 in the outer ring 32 extends in the direction of arrows 49 and causes a voltage to be induced in the coils 38, 39 and a current in the direction of the arrows 50.

Many different configurations of the windings 38, 39 are possible, for instance it being possible for the windings to be nested by overlapping. The interconnection of the vertical conductors 37 may be carried out according to many different winding patterns.

Figure 6:
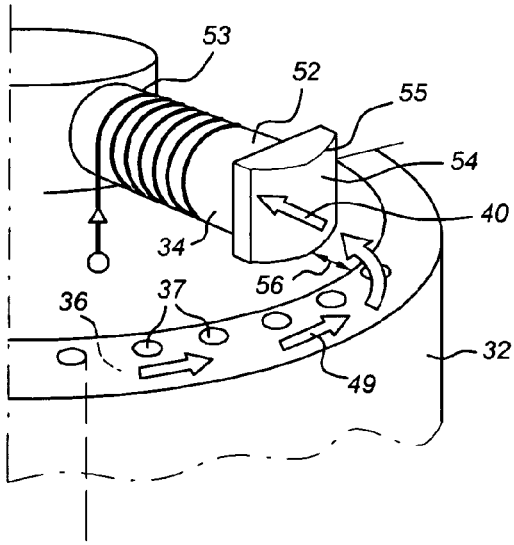
FIG. 6 shows a detail of the air gap in the swivel of FIG. 5.

As can be seen in FIG. 6, the radial arms 33, 34 comprise a radial member 53 and a transverse member 54 having a curved surface 55 corresponding with the cylindrical inner surface 36 of the outer ring 32. In the preferred embodiment, the transverse member 54 has a cylindrical surface as it reduces dielectric losses in the air gap. The air gap 56 between the cylindrical inner surface 36 and the curved surface 55 of the transverse member can be relatively small such as between 1 and 10 mm. The diameter of the outer ring 32 can be between 2 and 5 m as an example, for a power of 40 MVA at a medium voltage of 66 KV.

In fact, the diameter of the power swivel depends on many factors such as the number of poles, the windings configuration, the cooling requirements, and the coil connection scheme. Further, considering the manufacturing tolerances, the air gap can be between about 1 mm considering machining for the smallest diameter, up to 10 mm for bigger diameters and rougher manufacturing tolerances.

Figure 7:
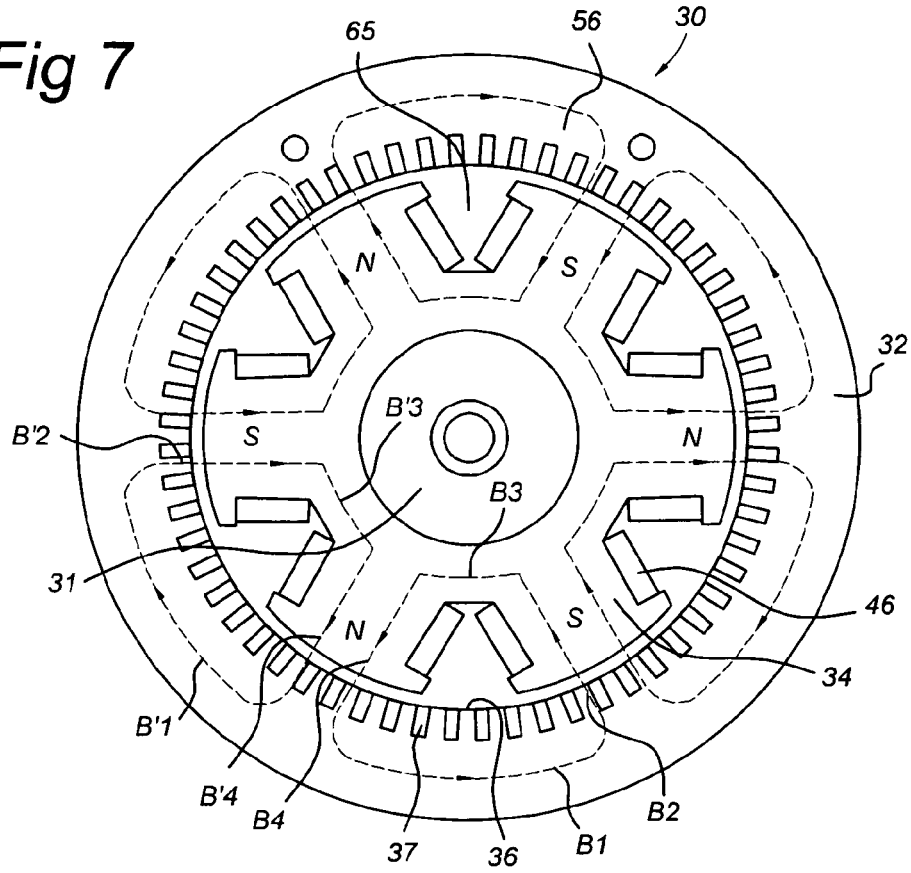
FIG. 7 shows a top view of the magnetic field in the swivel of FIG. 6.

In FIG. 7 it is shown that the current through the windings 46 around the transverse arms 34 is such that alternating poles N, S of opposed signs are formed for adjacent arms. The vertical conductors 37 can be seen to be distributed in a circumferential direction along the inner cylindrical surface 36 of the outer ring 32. Flux paths forming closed contours 56 are formed extending between the north pole N of a radial arm and the south pole S of adjacent arm along circumferential flux path sections B1, B1' in the outer ring 32, along first radial flux path sections B2, B2', along the hub flux path section B3, B3' and along second radial flux path sections B4, B4'.

In this embodiment six radial arms are shown but according to the present invention as the current needs to be single phase, at least two radial arms could suffice, and any embodiment comprising several pairs of arms would be according the present invention.

Figure 8:
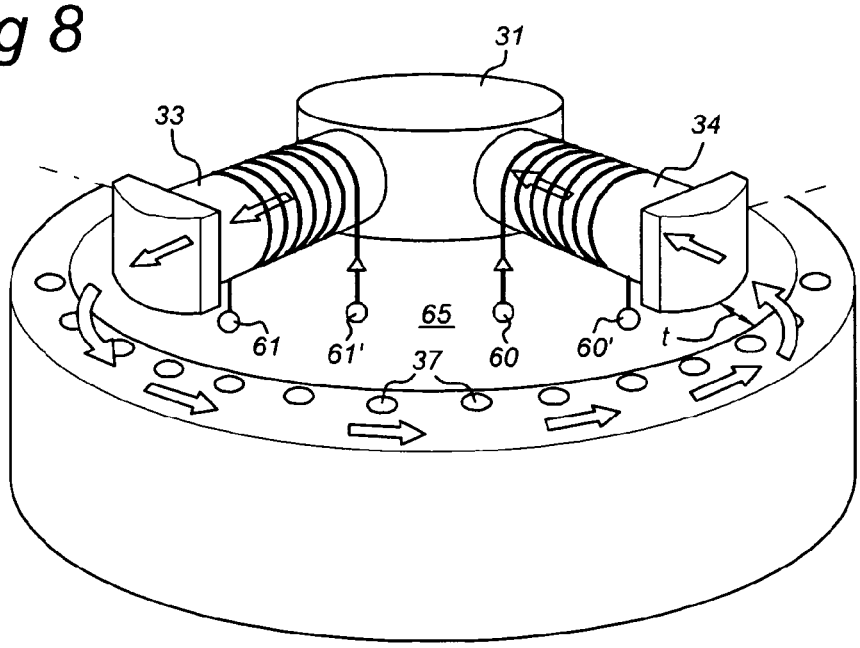
FIG. 8 shows a the power the swivel of FIG. 5 with power transforming properties.

FIG. 8 shows an embodiment wherein the windings around transverse arm 34 comprise a predetermined number such that a first voltage is generated between clamps 60,60' and wherein the number of windings around transverse arm 33 comprises a different number of windings such that a second voltage is generated between clamps 61,61'. For transformers the voltage ratio between the input voltage on vertical conductors 37 in the outer ring 32 and the output voltage is given by the ratio of the number of primary (stator) and secondary (rotor) windings. In this way a transformer for providing different voltages is obtained.

The efficiency of the high voltage transformer swivel is to be considered very similar to the relatively high efficiency of common transformers. Therefore, even if some heating is to be expected, cooling needs are expected to be lower than in converter stations. The open space 65 between adjacent radial arms provides an axial passage along which a cooling fluid, in the direction of the arrow C in FIG. 5 can be guided along the hub 31 and outer ring 32 either by convection or by forced circulation.

The present invention is more complex than a standard slip ring based High Voltage swivel, but sensibly extends the range of application for Alternative Current (AC) with respect to the much more complex High Voltage Direct Current (HVDC) system. Furthermore, it enables to use less expensive electric cables over medium-long distances.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

Figure 9:
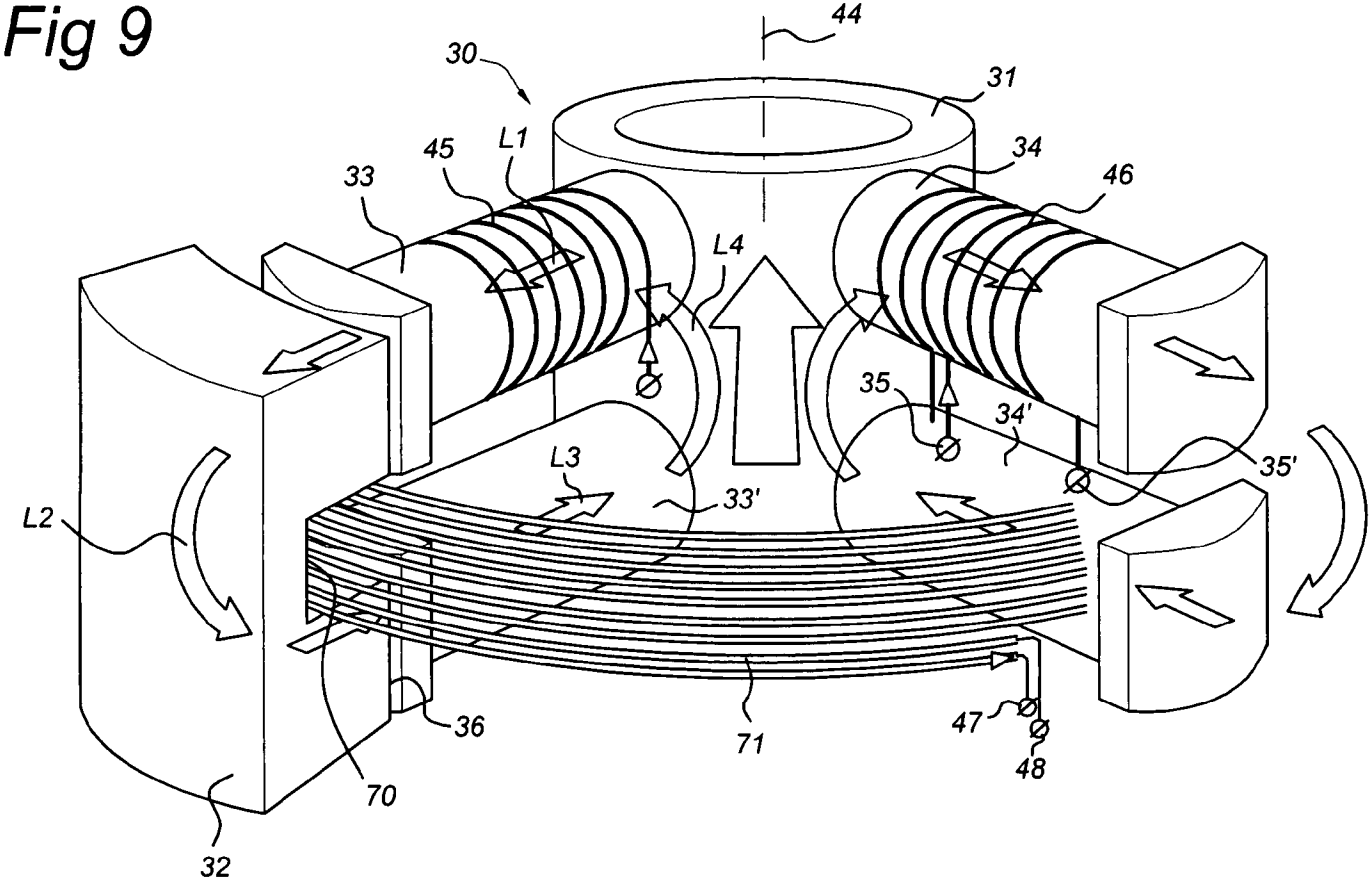
FIG. 9 shows a perspective view of another embodiment of an inductive power swivel having axially spaced-apart radial arms and circumferential windings.

FIG. 9 shows a power swivel 30 having a central hub 31 carrying pairs of radial arms 33, 33' and 34,34'. The arms in each pair are spaced-apart in the direction of the axis 44. The outer ring 32 comprises a circumferential groove 70 on the inner surface 36 in which circular conductors 71 extend in the circumferential direction. It is possible to also provide the lower radial arms 33', 34' with windings. The circular conductors 71 may extend radially inward towards the hub 44. The hub 44 may be hollow to allow the flow of a cooling fluid through the hub. A flux path is formed extending along radial flux path section L1 in the upper arm 33, vertcially downward along flux path section L2 in the outer ring 32, radially inward along flux path section L3 in the lower radial arm 33' and axially upward in the hub 31 along axial flux path section L4. The direction of the flux along the flux path sections L1-L4 depends on the direction of the current in the windings and may be directed radially outward in the upper radial arm 33 and radially inward through the lower radial arm 33', or may be reversed to be directed radially inward through the upper radial arm 33 and radially outward through the lower radial arm 33'.

The magnetic field in the power swivel according to the present embodiment will not have a phase shift in view of the circular conductors 71, and allows construction of a swivel with very compact radial dimensions.

The invention claimed is:

1. Power swivel (2, 30) for the transmission of electrical power from a first terminal (23, 35, 36) to a second terminal (28, 47, 48), the swivel comprising a central part with a hub (31) and an outer ring (32) of a magnetic material, coaxial with the hub and surrounding the hub, the outer ring and the central part being rotatable relative to one another around a vertical axis (44), at least two radial arms (33, 34) of a magnetic material projecting from the hub or from the outer ring, adjacent arms being spaced-apart, each arm carrying a conductor (45, 46) wound around the arm to form a coil adapted for generating a magnetic flux along a radial flux path through the arm, the conductors being connected to the first terminal (35, 35'), wherein the outer ring or the hub has a cylindrical surface (36) at close proximity to free ends of the arms (33, 34), a plurality of axially extending conductors (37) being distributed along the circumference of the outer ring (32)or hub (31) at or near the cylindrical surface (32) such that a number of axial conductors is each time situated between two adjacent radial arms, pairs of axial conductors forming coils situated along the cylindrical surface adapted for generating a magnetic flux along a magnetic flux path extending in a circumferential direction through the outer ring or hub, a closed contour (56) being formed extending radially outwardly from a first radial arm (B4), into the outer ring, via the outer ring to the adjacent radial arm (B1) and radially inwardly along said adjacent arm (B2) and via the hub back to the first arm (B3).

2. Power swivel (2, 30) according to claim 1 comprising at least two radial arms (33, 34), pairs of arms extending diametrically from the hub (31) or the outer ring (32), a first arm forming a magnetic pole of a predetermined sign (N), and, in case more than two arms are comprised, the diametrically opposed arm and the adjacent arms on each side of the first arm forming magnetic poles of the opposite sign (S).

3. Power swivel (2, 30) according to claim 1, wherein the conductors (45, 46) of at least two radial arms (33, 34) are connected in parallel to the first terminal (35, 36).

4. Power swivel (2, 30) according to claim 1, wherein at least two arms comprise a mutually different number of conductor windings, the two arms each being connected to a respective terminal.

5. Power swivel (2, 30) according to claim 1, the radial arms (33, 34) comprising a radial member (53) and at the free end a transverse member (54) having a cylindrical surface.

6. Power swivel (2, 30) according to claim 1, an open area (65) being defined between adjacent radial arms for forming an axial passage for a cooling medium.

7. Floating offshore structure (1) comprising a power swivel (2, 25, 30) according to claim 1, the structure comprising a hull and a turret (3) having a geostationary turret part provided with anchoring means (4) that are adapted to be moored to the sea bed (9), the stationary turret part being rotatably connected to the hull such that the hull can weathervane around the geostationary turret part, the power swivel being coaxially placed on the turret, a subsea electrical power cable (8) extending from a submerged position via the geostationary turret part to a first terminal (23) of the power swivel, an on-board power cable (11) extending from the second terminal (28) of the swivel to a position on the structure.

8. Floating offshore structure (1) according to claim 7, comprising at least one fluid swivel (17) having an inner ring-shaped member (16) connected to the geostationary turret part and to a subsea hydrocarbon transfer duct (5), and an outer ring-shaped member (19), coaxially arranged around the inner fluid swivel member (16) in a rotatable manner, the outer ring-shaped member (19) being connected to a fluid duct (14) such as to be rotatable with the fluid duct and the vessel relative to the geostationary turret part, the central part of the power swivel (2, 25, 30) being placed on the inner ring-shaped member (16), co-axial therewith, the power cable (8) extending through a central space of the inner ring-shaped member (16) of the fluid swivel (17) to the central part of the power swivel.

9. Power swivel (2, 30) according to claim 2, wherein the conductors (45, 46) of at least two radial arms (33, 34) are connected in parallel to the first terminal (35, 36).

10. Power swivel (2, 30) according to claim 2, wherein at least two arms comprise a mutually different number of conductor windings, the two arms each being connected to a respective terminal.

11. Power swivel (2, 30) according to claim 3, wherein at least two arms comprise a mutually different number of conductor windings, the two arms each being connected to a respective terminal.

12. Power swivel (2, 30) according to claim 2, an open area (65) being defined between adjacent radial arms for forming an axial passage for a cooling medium.

* * * * *